US009934647B2

(12) United States Patent
Lyons et al.

(10) Patent No.: US 9,934,647 B2
(45) **Date of Patent: *Apr. 3, 2018**

(54) SYSTEM AND METHOD TO PROVIDE USER-CONFIGURABLE PREFERENCES AND/OR OPTIONS FOR TEAM PLAY ON A SINGLE GAMING MACHINE

(71) Applicant: Bally Gaming, Inc., Las Vegas, NV (US)

(72) Inventors: Martin Lyons, Las Vegas, NV (US); Brett Jackson, Las Vegas, NV (US); Ian Arrowsmith, Las Vegas, NV (US); William Wadleigh, Las Vegas, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/625,316

(22) Filed: Jun. 16, 2017

(65) Prior Publication Data

US 2017/0287265 A1 Oct. 5, 2017

Related U.S. Application Data

(63) Continuation of application No. 14/249,222, filed on Apr. 9, 2014, now Pat. No. 9,691,218.

(60) Provisional application No. 61/810,511, filed on Apr. 10, 2013.

(51) Int. Cl.
*G07F 17/32* (2006.01)

(52) U.S. Cl.
CPC ..... *G07F 17/3223* (2013.01); *G07F 17/3227* (2013.01); *G07F 17/3274* (2013.01)

(58) Field of Classification Search
CPC ..... G07F 17/3223; G07F 17/3227; G07F 17/3274
USPC ..... 463/31
See application file for complete search history.

(56) References Cited

U.S. PATENT DOCUMENTS

| | | | | |
|---|---|---|---|---|
| 4,824,121 | A | 4/1989 | Beall et al. | |
| 5,971,397 | A | 10/1999 | Miguel et al. | |
| 2003/0224852 | A1 * | 12/2003 | Walker | G07F 17/32 463/20 |

(Continued)

*Primary Examiner* — David L Lewis
*Assistant Examiner* — Shauna-Kay Hall
(74) *Attorney, Agent, or Firm* — Seed Intellectual Property Law Group LLP

(57) ABSTRACT

A method and system to provide user-configurable preferences and/or options for team play on a single gaming machine is disclosed. According to one embodiment, a computer-implemented gaming system comprises a memory device having stored thereon a gaming application that enables multiplayer, turn-based gameplay among one or more players. A computer-processing unit is operatively connected to the memory device and processes the gaming application to enable the one or more players to specify a condition for determining when a player's turn at gameplay ends. Processing the gaming application further includes determining that the condition is satisfied for a current player and generating a message to indicate that the current player's turn at gameplay is terminated. A display presents the generated message to the one or more players.

20 Claims, 14 Drawing Sheets

(56) References Cited

U.S. PATENT DOCUMENTS

| | | | | |
|---|---|---|---|---|
| 2006/0094495 | A1* | 5/2006 | Gelber | G07F 17/3244 463/20 |
| 2006/0121971 | A1 | 6/2006 | Slomiany et al. | |
| 2008/0293471 | A1 | 11/2008 | Kim et al. | |
| 2008/0318656 | A1 | 12/2008 | Walker et al. | |
| 2009/0117989 | A1 | 5/2009 | Arezina et al. | |
| 2009/0275411 | A1 | 11/2009 | Kisenwether et al. | |
| 2011/0117982 | A1 | 5/2011 | Nguyen | |
| 2013/0090164 | A1 | 4/2013 | Moshal | |

* cited by examiner

SYSTEM AND METHOD TO PROVIDE USER-CONFIGURABLE PREFERENCES AND/OR OPTIONS FOR TEAM PLAY ON A SINGLE GAMING MACHINE

CROSS-REFERENCE TO RELATED APPLICATIONS

The present application is a continuation of U.S. application Ser. No. 14/249,222 filed Apr. 9, 2014; which claims the priority and benefits of U.S. Provisional Application No. 61/810,511 filed on Apr. 10, 2013, which are incorporated by reference herein in their entirety.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND

Technical Field

The present disclosure generally relates to a method and system for team play gaming and, more particularly, to a method and system for improving the experience of gaming sessions shared by friends, such as at a slot machine or other gaming machine in a casino.

Description of the Related Art

Playing gaming machines is an enjoyable pastime for many people. Gaming machines include machines that are typically operated by a user by inserting coins, tokens, credit cards, smart cards, tickets or coupons with monetary value. The machines may include, e.g., slot machines, pinball machines, video games and computer stations for playing games alone or with other users, such as bingo, card games and the like. The machines may operate based on both luck and the user's skill. Such gaming machines may be located in casinos, video arcades, gas stations, bars or any other location. The gaming machines may be used for gambling, where the user receives a monetary or other prize when the machine pays off, or simply for amusement.

It is quite common for friends to play slot machine games together. A typical use case is where friends are gathered at a bar, playing a single slot game on the bartop. At the start of play each player inserts their contribution into the bill acceptor of the gaming machine (e.g., $20). If four players were to be playing, the initial credit of $80 is played by the team, with each player taking it in turns pressing the spin button. Usually some informal arrangement is made prior to playing with regard to a stop condition. A common example may be to play until the credits are doubled or exhausted.

While fun, there are some problems with informal teams. It is easy to lose track of who is to spin next. It is also very difficult to see at the end of play who was the most successful player. In addition, more complex rules that dictate which player is to play next are difficult to follow or enforce. While players may share winnings, only one player is able to claim player-tracking credits for the gaming session.

There is a need for, and the present application discloses, a method and system to overcome the above limitations and provide user-configurable rules for team play on a single gaming machine.

BRIEF SUMMARY

A method and system to provide user-configurable preferences and/or options for team play on a single gaming machine is disclosed. According to one embodiment, a computer-implemented gaming system comprises a memory device having stored thereon a gaming application that enables multiplayer, turn-based gameplay among one or more players. A computer-processing unit is operatively connected to the memory device and processes the gaming application to enable the one or more players to specify a condition for determining when a player's turn at gameplay ends. Processing the gaming application further includes determining that the condition is satisfied for a current player and generating a message to indicate that the current player's turn at gameplay is terminated. A display displays the generated message to the one or more players.

According to another embodiment, a non-transitory, computer-readable medium having stored thereon computer-executable instructions that, when executed by a computer processor, cause the computer processor to provide a multiplayer, turn-based game among one or more players. When executed, the instructions also enable the one or more players to specify a condition for determining when a player's turn at gameplay ends. Determining that the condition is satisfied for a current player, the instructions generate a message to indicate that the current player's turn at gameplay is terminated and displays the generated message to the one or more players.

According to another embodiment, a computer-implemented method displays a multiplayer, turn-based game to one or more players on a computer-driven display. The computer-implemented method receives, via a user-input device, user input from the one or more players. The user input includes specifying a condition for determining when a player's turn at gameplay ends. Based on the game's instructions and user-specified parameters, the computer-implemented method performs calculations to determine that the condition is satisfied for a current player and generates a message to indicate that the current player's turn at gameplay is terminated. The computer-implemented method displays the generated message to the current player on the computer-driven display.

The detailed description of the present system and method below is for the purpose of fully disclosing various embodiments and not intended to limit the scope of the present system and method.

BRIEF DESCRIPTION OF THE SEVERAL VIEWS OF THE DRAWINGS

The present application will be more fully understood by reference to the following figures, which are for illustrative purposes only. The figures are not necessarily drawn to scale and elements of similar structures or functions are generally represented by like reference numerals for illustrative purposes throughout the figures. The figures are only intended to facilitate the description of the various embodiments described herein. The figures do not describe every aspect of the teachings disclosed herein and do not limit the scope of the claims.

DETAILED DESCRIPTION

Figure 1:
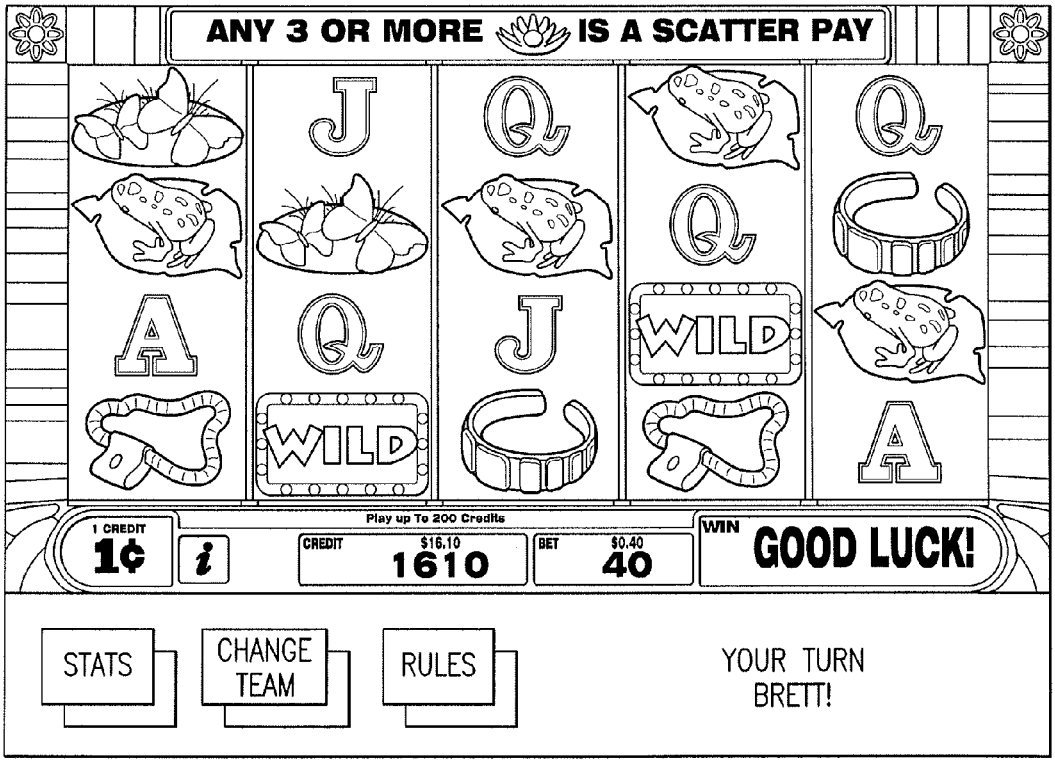
FIG. 1 illustrates an example of a slot machine game interface that includes a team play window in accordance with one or more embodiments.

Persons of ordinary skill in the art would understand that the present disclosure is illustrative only and not in any way limiting. Other embodiments of the disclosed system and method to provide user-configurable preferences and/or options for team play may suggest themselves to such skilled persons having the benefit of this disclosure.

Each of the features and teachings disclosed herein can be utilized separately or in conjunction with other features and teachings to provide a system and method to provide user-configurable preferences and/or options for team play on a single gaming machine. Representative examples utilizing many of these additional features and teachings, both separately and in combination, are described in further detail with reference to the attached figures. This detailed description is merely intended to teach a person of skill in the art further details for practicing aspects of the present teachings and is not intended to limit the scope of the claims. Therefore, combinations of features disclosed above in the detailed description may not be necessary to practice the teachings in the broadest sense, and are instead taught merely to describe particularly representative examples of the present teachings.

In the description below, for purposes of explanation only, specific nomenclature is set forth to provide a thorough understanding of the present system and method. However, it will be apparent to one skilled in the art that these specific details are not required to practice the teachings of the present system and method.

Some portions of the detailed descriptions herein are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the below discussion, it is appreciated that throughout the description, discussions utilizing terms such as "processing," "computing," "calculating," "determining," "displaying," or the like, refer to the actions and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The present application also relates to an apparatus for performing the operations herein. This apparatus may be specially constructed for the required purposes, or it may comprise a general purpose computer selectively activated or reconfigured by a computer program stored in the computer. Such a computer program may be stored in a computer readable storage medium, such as, but not limited to, any type of disk, including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions, and each coupled to a computer system bus.

The algorithms presented herein are not inherently related to any particular computer or other apparatus. Various general purpose systems, computer servers, or personal computers may be used with programs in accordance with the teachings herein, or it may prove convenient to construct a more specialized apparatus to perform the required method steps. The required structure for a variety of these systems will appear from the description below. It will be appreciated that a variety of programming languages may be used to implement the teachings of the disclosure as described herein.

Moreover, the various features of the representative examples and the dependent claims may be combined in ways that are not specifically and explicitly enumerated in order to provide additional useful embodiments of the present teachings. It is also expressly noted that all value ranges or indications of groups of entities disclose every possible intermediate value or intermediate entity for the purpose of original disclosure, as well as for the purpose of restricting the claimed subject matter. It is also expressly noted that the dimensions and the shapes of the components shown in the figures are designed to help to understand how the present teachings are practiced, but not intended to limit the dimensions and the shapes shown in the examples.

In accordance with one or more embodiments, FIG. 1 shows a game (101) running on an electronic gaming machine (EGM) with a DM window (102) visible below. The DM window has some controls (for clarity only three are shown here) and a message (103) as to whose turn it is next to play. The name of the current player (e.g., Brett) is either obtained from player tracking information or from team information associated with the player tracking account. Teams may also be informally created without reference to the player tracking system.

Figure 2:
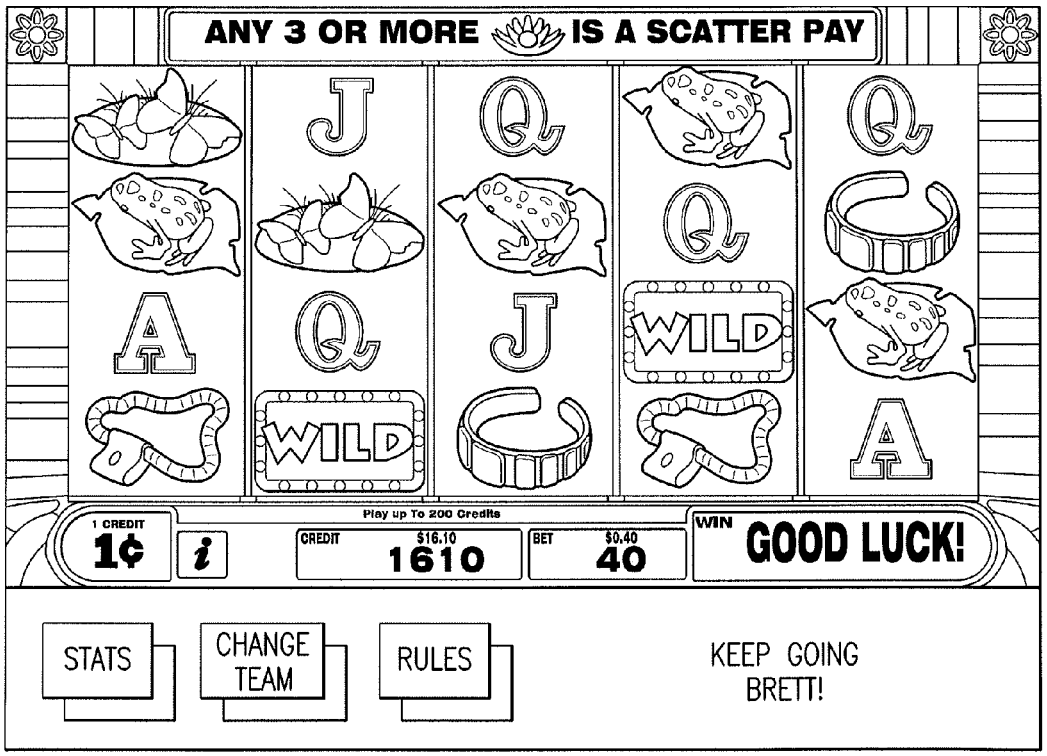
FIG. 2 illustrates an example of a message provided to a player when a losing spin occurs in accordance with one or more embodiments.

After Brett has pressed the spin button, the message changes. FIG. 2, in accordance with one or more embodiments, shows an updated message (203), to let Brett know to keep going. Rather than having each player alternate individual spins, which slows down game play drastically, it is possible to have each player keep playing for either a set number of spins, or until they have a win (either of any type or above a certain threshold). In other words, the disclosed system and method enables players to specify preferences and/or options which the system and method uses to determine when a player's turn ends and apprise players of whose turn it is to play. Players may find such rules difficult to follow without the disclosed system and method to provide user-configurable preferences and/or options for team play, particularly in a bar type environment.

Figure 3:
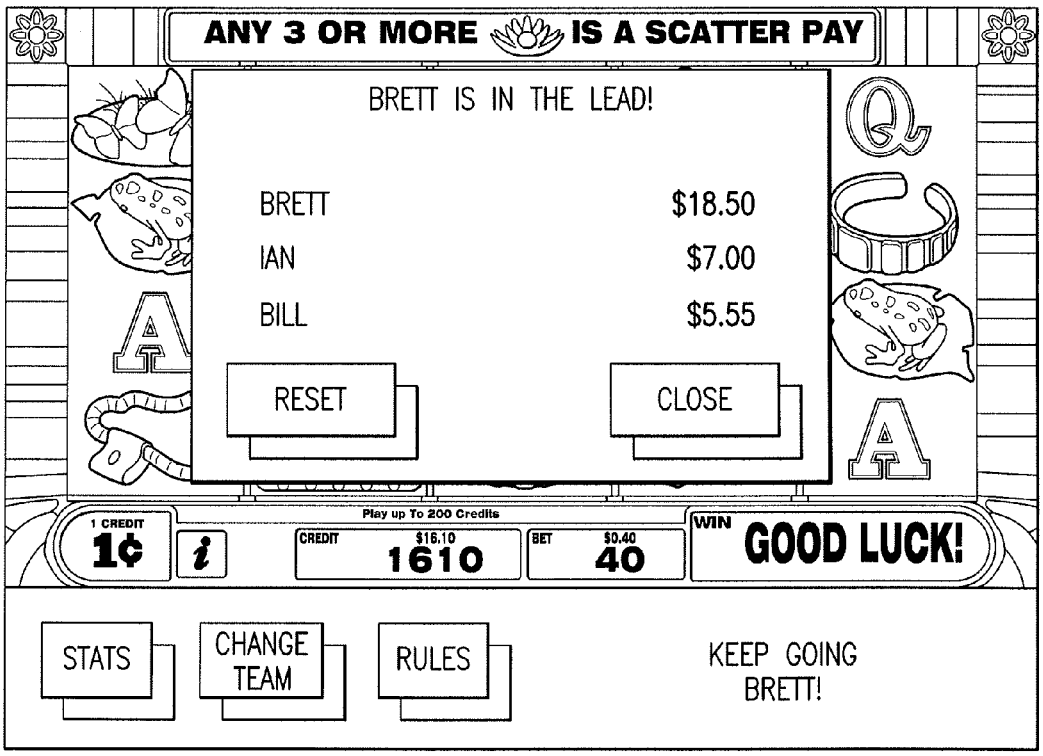
FIG. 3 illustrates an example of a current statistical display for a gaming session in accordance with one or more embodiments.

FIG. 3, in accordance with one or more embodiments, shows a current display of the team's statistics that may be available to the players at any time. The availability of the team's statistics adds to the entertainment value of the game to the players. In addition to the amounts won since the session began (or the statistics reset), these statistics may include other information such as "Free spins won" or "5 of a kinds hit," allowing players to compete against each other within the team. Periodically, players may wish to reset these statistics—for example, if they insert further credits—so the option to reset back to zero at any time may be offered.

Figure 4:
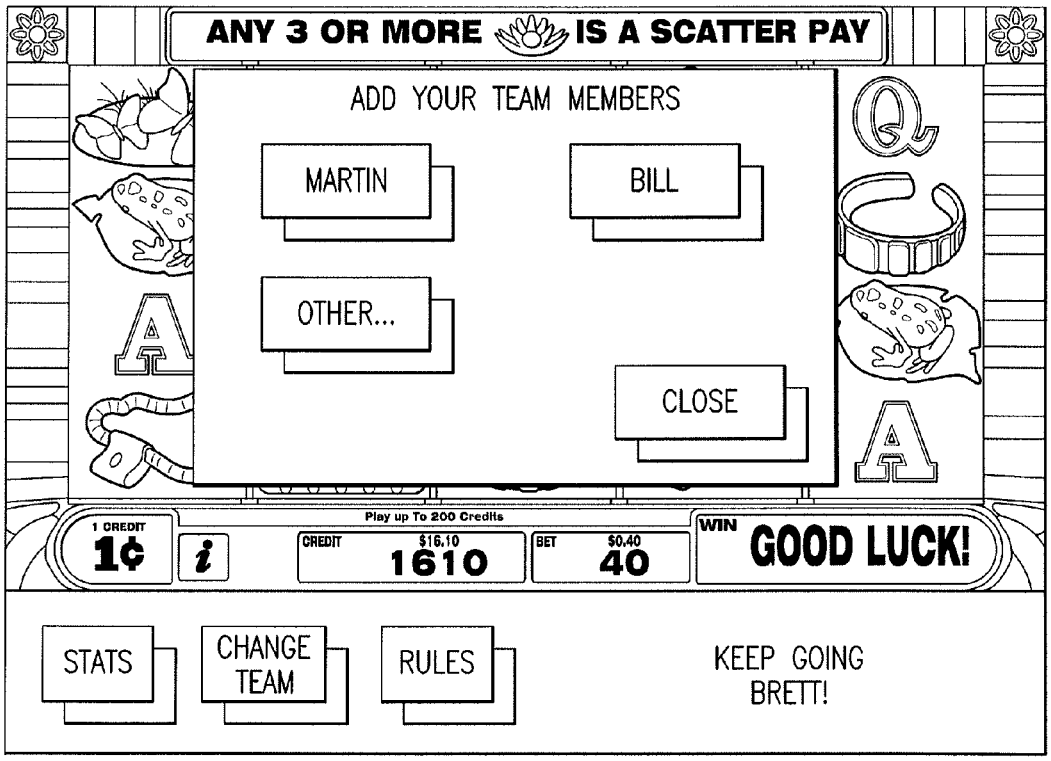
FIG. 4 illustrates an example of a game interface for configuring teams in accordance with one or more embodiments.
Figure 5:
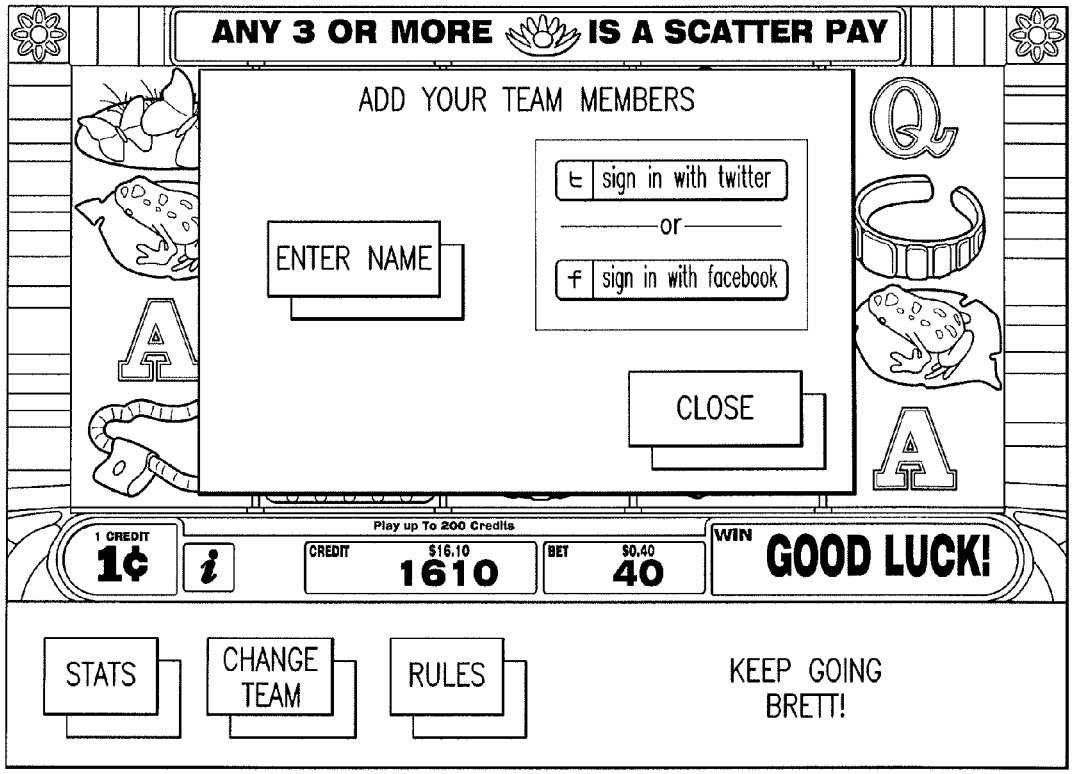
FIG. 5 illustrates another example of a game interface for configuring teams that enables manual entry or automatic sign-in using social networking login information in accordance with one or more embodiments.

In accordance with one or more embodiments, FIG. 4 illustrates an example of a game interface for configuring teams. The gaming machine displays potential team members who previously played with the player associated with the currently inserted player tracking card. To determine the potential team members, the gaming machine may retrieve the player's information from a player tracking server, including information on the player's past team members. In the example shown, there are two previous team members who have played with this player—Martin and Bill. If a new team member is needed to be added, then the dialog box shown in FIG. 5 is displayed in response to the player clicking the "Other . . . " button.

As can be seen in FIG. 5, in accordance with one or more embodiments, players may be added manually or be added by use of social networking sign-ins such as Facebook® or Twitter®. Using a social network sign-in may remove the need for the player being added to insert his player tracking card. For example, if the player previously associated his Facebook® ID with his player tracking card, the player's name and, optionally, his player tracking account number may be retrieved (e.g., from the player tracking server) when the player signs using his Facebook® credentials.

Figure 6:
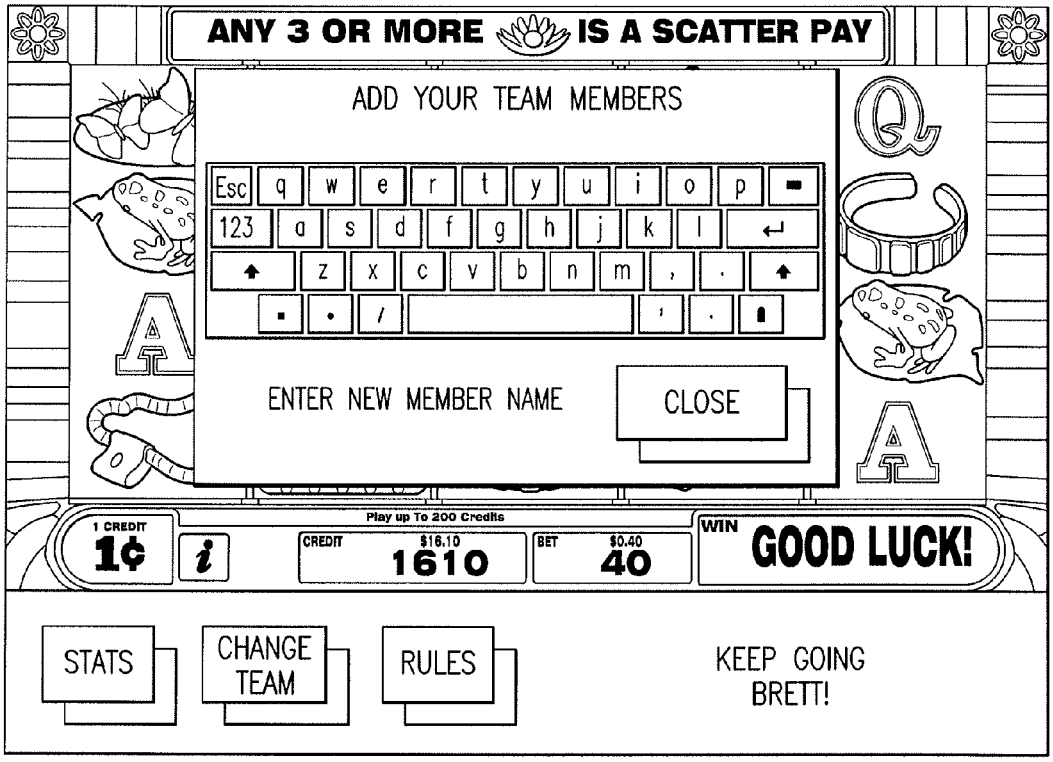
FIG. 6 illustrates an example of an on-screen keyboard for manually entering a player's name in accordance with one or more embodiments.

In accordance with one or more embodiments, FIG. 6 shows an on-screen keyboard for the manual entry of a team member's name. A team member's name may be associated with his player tracking account number. For example, a slot management system may maintain a list of 'handles' for players and allow team members' names to be associated with their player tracking account number. This would remove the need to insert a second player tracking card to associate an account with the team member's name. Once a team member has been entered or signed in from a social network, his name may be available for selection as a team member, as shown in FIG. 4, by the primary player (i.e., player whose player tracking number was first used to initiate game play).

Figure 7:
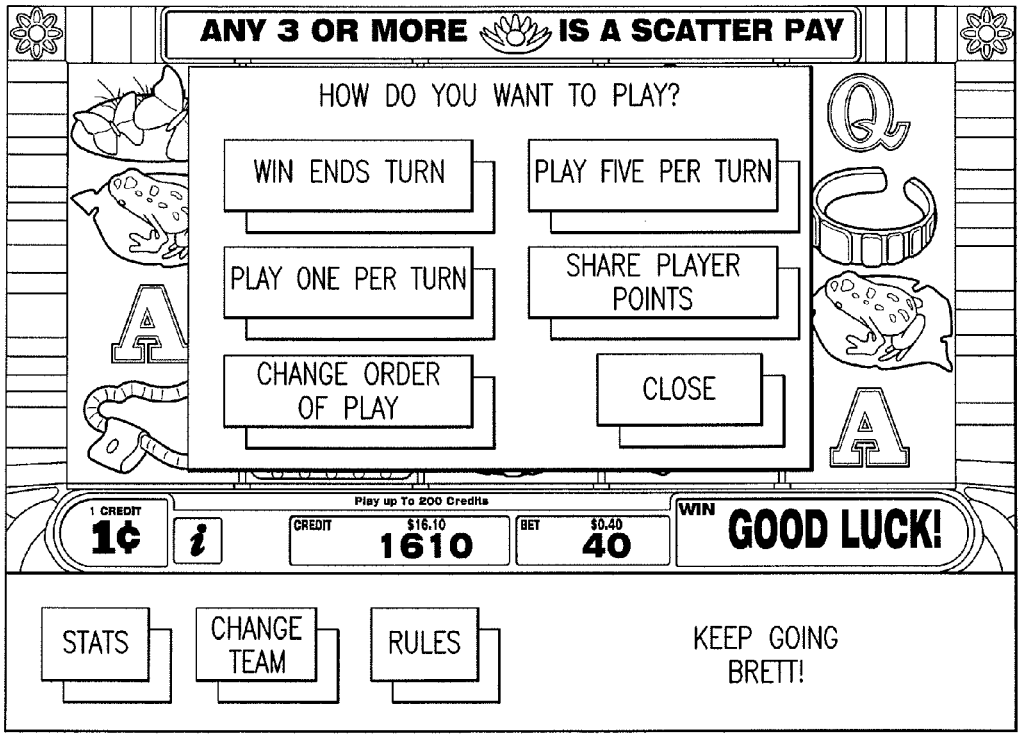
FIG. 7 illustrates an example of a game interface for configuring team play preferences and options in accordance with one or more embodiments.

FIG. 7 illustrates an example of a game interface for configuring team play preferences and/or options in accordance with one or more embodiments. Examples of the preferences and/or options include:

"Play one per turn"—Each player takes turn hitting the spin button. After the end of each turn, a message is displayed to indicate the next player in the rotation.

"Play five per turn"—Each player takes turn playing 5 spins at a time. A message that counts down after each spin—for example saying "Two spins left, Brett"—is displayed. After 5 spins, the message is updated to indicate the next player in the rotation.

"Win ends turn"—A player may keep playing until he or she hits a win. If a player hits a winning combination, his turn ends. The winning condition may be defined by players. For example, a win may only end a turn if the winnings are greater than a certain value. An iView module, as further described below, determines when a qualifying win has occurred by examining slot accounting data sent from the EGM to the back-end system (such as by the SAS protocol) and uses this data accordingly.

"Change order of play"—This is a randomizer option that changes the order of players in the rotation. This may be used by players at the start of a session to determine the play order, and also may be used periodically if it is felt that another order of play would be more "lucky."

"Share player points"—This is an option that is available if more than one player tracking account has been associated with the team. If the option is enabled, rather than all points going to the carded-in player, points are shared among the team members' player tracking accounts (e.g., signed-in via a social network or other system).

Another possible preference/option (not shown) is the ability to set a stop condition. According to one or more embodiments, the disclosed system and method enables players to set a preference/option such that when the credit meter goes above a certain amount, play is paused until the team decides whether to cash out or continue. Other preferences and/or options are possible without deviating from the spirit and scope of the system and method. Furthermore, a person of ordinary skill in the art would understand that the preferences and/or options may be used in various combinations.

Figure 8:
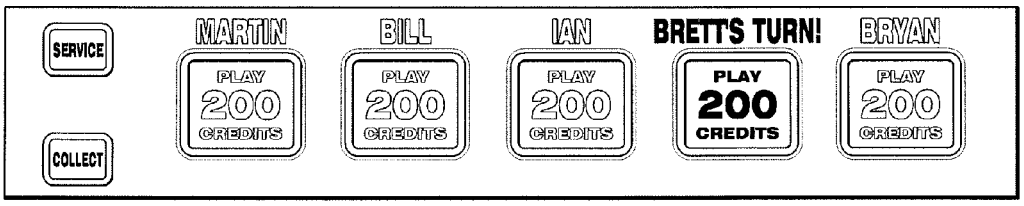
FIG. 8 illustrates an example of a team play window in accordance with one or more embodiments.

In accordance with one or more embodiments, an example of a team play window is shown in FIG. 8. The team-play interface is built into a game and delivered by a Bally iDeck™ (see below), which enables individual spin buttons to be customized to each player. Providing individual spin buttons makes it easier for players to recognize when it is their turn and reduces the chance that a player 'accidentally' hits the spin button out of turn. In the example shown, only one button is active—Brett's—so pressing any of the other buttons would not work. Buttons may be virtual buttons (e.g., touchscreen "buttons") or actual physical buttons.

According to one or more embodiments, instead of entering team member names, the disclosed system and method to provide user-configurable preferences and/or options for team play may present players with a set of 'lucky' icons or playing pieces in a menu. Each player would select a playing piece and this piece would be shown as a replacement for the player's name. For example, a player would know that it is his turn to play when a "horseshoe"—his chosen playing piece—is displayed.

Figure 9:
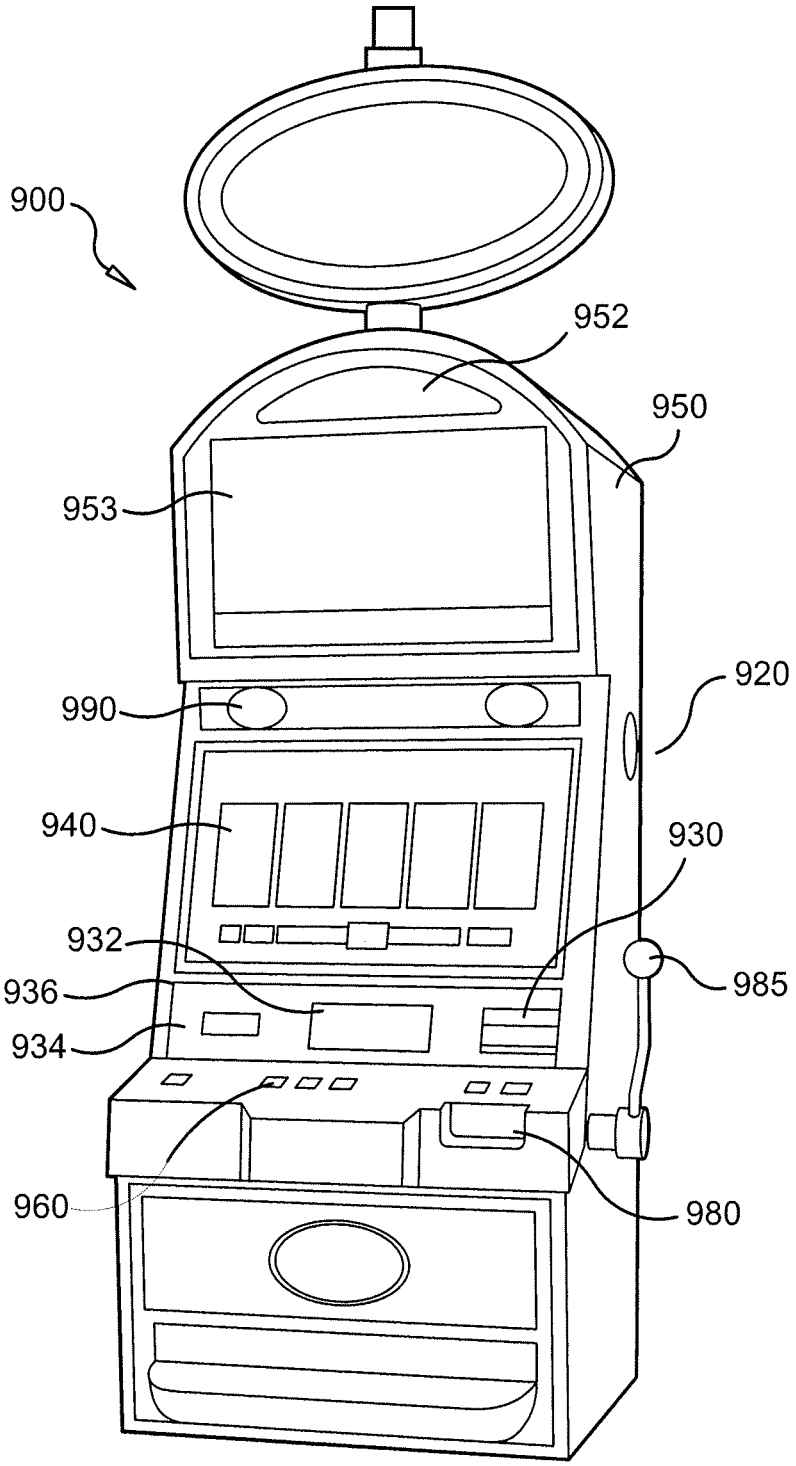
FIG. 9 illustrates a perspective view of an exemplary gaming machine in accordance with one or more embodiments.

Referring to FIG. 9, gaming machine 900 capable of supporting various embodiments of the disclosed system and method to provide user-configurable preferences and/or options for team play is shown, including cabinet housing 920, primary game display 940 upon which a primary game and feature game may be displayed, top box 950 which may display multiple progressives that may be won during play of the feature game, player-activated buttons 960, player tracking panel 936, bill/voucher acceptor 980 and one or more speakers 990. Cabinet housing 920 may be a self-standing unit that is generally rectangular in shape and may be manufactured with reinforced steel or other rigid materials which are resistant to tampering and vandalism. Cabinet housing 920 may alternatively be a handheld device including the gaming functionality and various components as discussed herein. For example, a handheld device may be a cell phone, personal data assistant, or laptop or tablet computer, each of which may include a display, a processor, and memory sufficient to support either stand-alone capability such as gaming machine 900 or thin client capability such as incorporating some of the capabilities of a remote server.

In one or more embodiments, cabinet housing 920 houses a processor, circuitry, and software (not shown) for receiving signals from the player-activated buttons 960, operating the games, and transmitting signals to the respective displays and speakers. Any shaped cabinet may be implemented with any embodiment of gaming machine 900 so long as it provides access to a player for playing a game. For example, cabinet 920 may comprise a slant-top, bar-top, or table-top style cabinet, including a Bally Cinevision™ or CineReels™ cabinet. The operation of gaming machine 900 is described more fully below.

The plurality of player-activated buttons 960 may be used for various functions such as, but not limited to, selecting a wager denomination, selecting a game to be played, selecting a wager amount per game, initiating a game, or cashing out money from gaming machine 900. Buttons 960 may be operable as input mechanisms and may include mechanical buttons, electromechanical buttons or touch screen buttons. Optionally, a handle 985 may be rotated by a player to initiate a game.

In one or more embodiments, buttons 960 may be replaced with various other input mechanisms known in the art such as, but not limited to, a touch screen system, touch pad, track ball, mouse, switches, toggle switches, or other input means used to accept player input such as a Bally iDeck™—an enhanced game play system that includes a display system, a sensor system, a feedback system, and one or more computing systems—disclosed in at least U.S. patent application Ser. No. 12/619,635, entitled "Gesture Enhanced Input Device," filed Nov. 16, 2009, which is incorporated herein by reference in its entirety. Another example of input means is a universal button module as disclosed in U.S. application Ser. No. 11/106,212, entitled "Universal Button Module," filed on Apr. 14, 2005, which is hereby incorporated by reference. Generally, the universal button module provides a dynamic button system adaptable for use with various games and capable of adjusting to gaming systems having frequent game changes. More particularly, the universal button module may be used in connection with playing a game on a gaming machine and may be used for such functions as selecting the number of credits to bet per hand.

Cabinet housing 920 may optionally include top box 950 which contains "top glass" 952 comprising advertising or payout information related to the game or games available on gaming machine 900. Player tracking panel 936 includes player tracking card reader 934 and player tracking display 932. Voucher printer 930 may be integrated into player tracking panel 936 or installed elsewhere in cabinet housing 920 or top box 950.

Game display 940 may present a game of chance wherein a player receives one or more outcomes from a set of potential outcomes. For example, one such game of chance is a video slot machine game. In other aspects of the disclosed system and method to provide user-configurable preferences and/or options for team play, gaming machine 900 may present a video or mechanical reel slot machine, a video keno game, a lottery game, a bingo game, a Class II bingo game, a roulette game, a craps game, a blackjack game, a mechanical or video representation of a wheel game or the like.

Mechanical or video/mechanical embodiments may include game displays such as mechanical reels, wheels, or dice as required to present the game to the player. In video/mechanical or pure video embodiments, game display 940 is, typically, a CRT or a flat-panel display in the form of, but not limited to, liquid crystal, plasma, electroluminescent, vacuum fluorescent, field emission, or any other type of panel display known or developed in the art. Game display 940 may be mounted in either a "portrait" or "landscape" orientation and be of standard or "widescreen" dimensions (i.e., a ratio of one dimension to another of at least 16×9). For example, a widescreen display may be 32 inches wide by 18 inches tall. A widescreen display in a "portrait" orientation may be 32 inches tall by 18 inches wide. Additionally, game display 940 may include a touch screen or touch glass system (not shown) and presents player interfaces such as, but not limited to, credit meter (not shown), win meter (not shown) and touch screen buttons (not shown). An example of a touch glass system is disclosed in U.S. Pat. No. 6,942,571, entitled "Gaming Device with Direction and Speed Control of Mechanical Reels Using Touch Screen," which is hereby incorporated by reference in its entirety for all purposes.

Game display 940 may also present information such as, but not limited to, player information, advertisements and casino promotions, graphic displays, news and sports updates, or even offer an alternate game. This information may be generated through a host computer networked with gaming machine 900 on its own initiative or it may be obtained by request of the player using either one or more of the plurality of player-activated buttons 960; the game display itself, if game display 940 comprises a touch screen or similar technology; buttons (not shown) mounted about game display 940 which may permit selections such as those found on an ATM machine, where legends on the screen are associated with respective selecting buttons; or any player input device that offers the required functionality.

Cabinet housing 920 incorporates a single game display 940. However, in alternate embodiments, cabinet housing 920 or top box 950 may house one or more additional displays 953 or components used for various purposes including additional game play screens, animated "top glass," progressive meters or mechanical or electromechanical devices (not shown) such as, but not limited to, wheels, pointers or reels. The additional displays may or may not include a touch screen or touch glass system.

The gaming machine 900 includes various electronic components for generating sound. Note that the functionality discussed herein may be implemented using software and/or hardware techniques and components known to those skilled in the art. The processor with associated memory (not shown) may provide digital sound files, e.g., in a WAV or MP3 format, to a sound card (not shown). Particular sound files may be selected by the processor to enable the gaming machine 900 to make various sounds according to factors such as whether the machine is being played, and whether a jackpot has been won. A typical sound card includes a digital signal processor (DSP) that handles most computations, a digital to analog converter (DAC) for audio leaving the card, a read-only memory (ROM) or flash memory for storing data, and a jack for connecting to speakers 990. Moreover, the sound card may have a microphone jack and an analog-to-digital converter (ADC) for converting analog audio signals from a microphone (not shown). The sound card translates the control signals to left- and right-channel (and any other channels) audio signals that produce sound by exciting the speakers 990.

Note that two audio channels are used to provide a stereo effect in the present example, but fewer or more channels may be used according to the audio quality or effect that is desired. For example, multiple channels of audio may be used to provide multiple sounds such as stereo music and the like.

The processor implements a game sound selection algorithm to adjust the audio output of machine 900 based on the noise characteristics of an environment in which the machine 900 is located. In particular, the microphone may provide a signal to the sound card from which the ambient noise level and frequencies are determined. One or more microphones may be used and can be positioned as desired to accurately pick up the ambient noise level. For a gaming machine, the microphone may be located on an outer surface of machine 900 or otherwise proximate to the machine, or in some other location which is expected to accurately capture the ambient noise level near the machine. For example, the top portion of some gaming machines has lights in an area known as the "candle" where the microphone may be located. Moreover, it is helpful if the microphone is located generally near the user's ear since the sound adjustment should be based on the noise that the user hears when playing the gaming machine. Moreover, the microphone should be in a location that results in a relatively low coupling with the sound emitted from gaming machine 900's speakers 990. Moreover, a directional microphone may be used that is aimed appropriately away from the speakers. A wired or wireless link between the microphone and gaming machine 900 may also be used. The microphone may be added and coupled to the sound card using various techniques that should be apparent to those skilled in the art. For example, a hole can be drilled in the body of machine 900 to hold a microphone, and a wire run within the cabinet from the microphone to a microphone jack at the sound card.

Figure 10A:
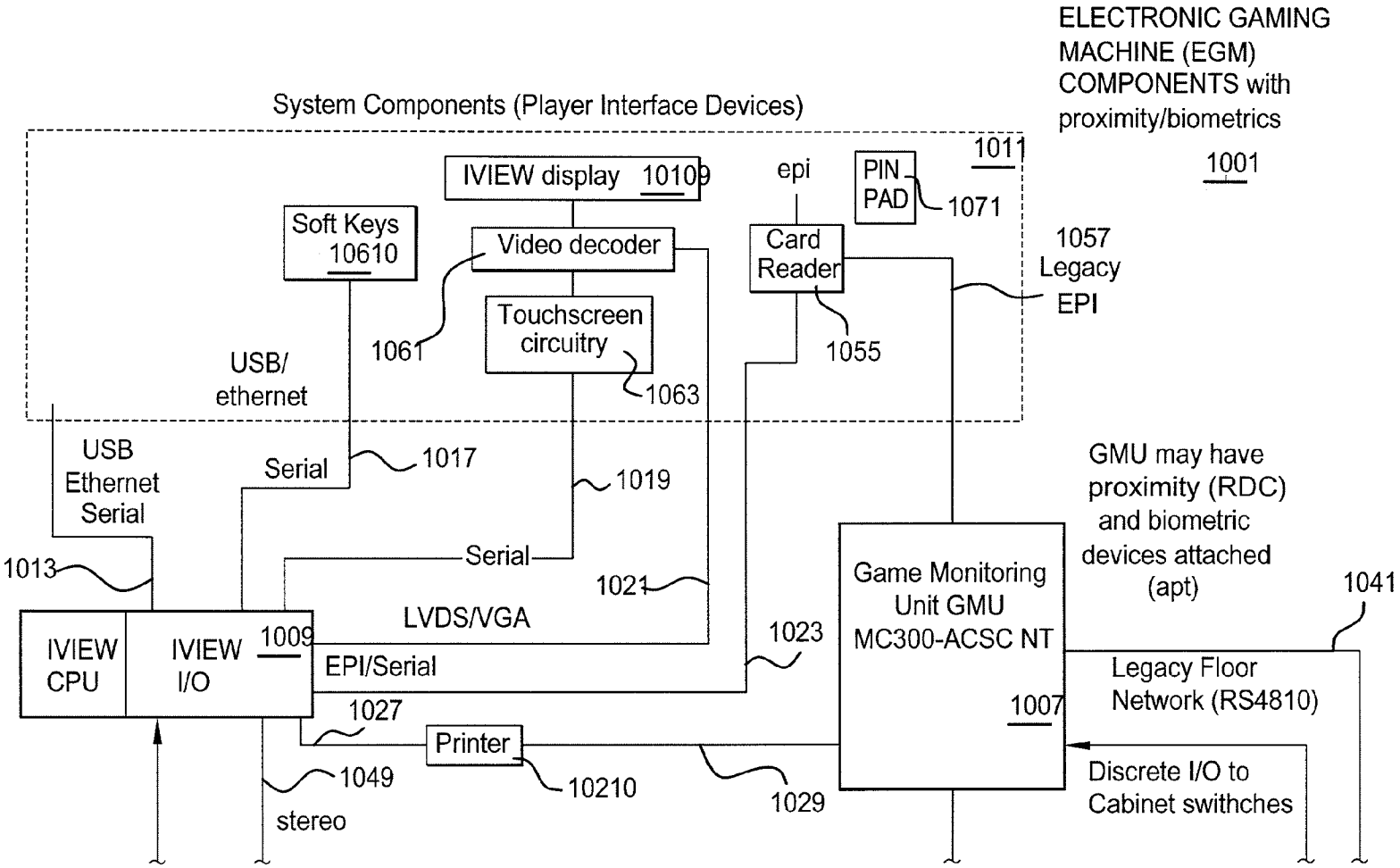
FIGS. 10A-10B illustrates a block diagram of the physical and logical components of the gaming machine of FIG. 9 in accordance with one or more embodiments.
Figure 10B:
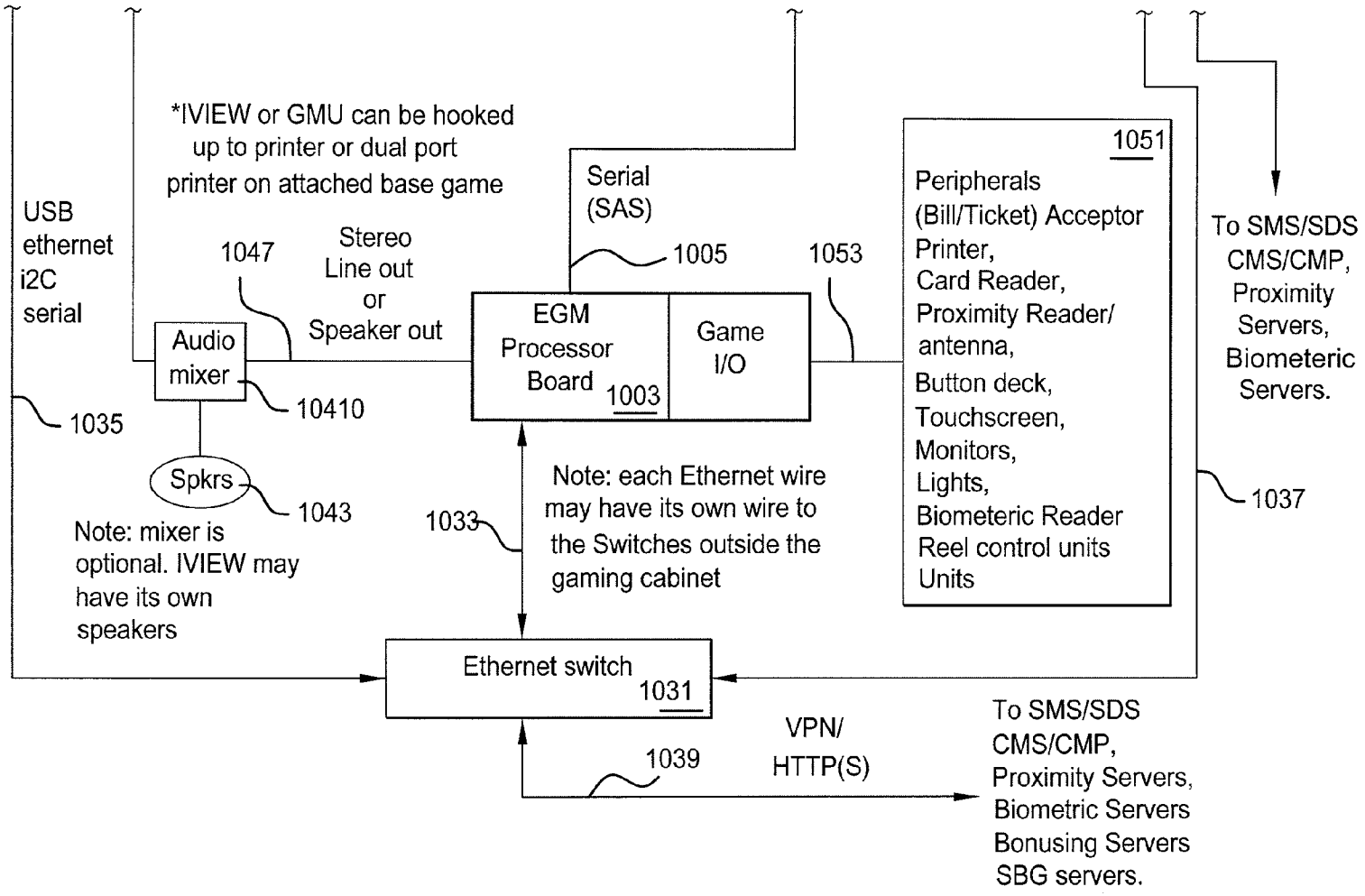

Referring to FIGS. 10A-10B, electronic gaming machine 1001 is shown in accordance with one or more embodiments. Electronic gaming machine 1001 includes base game integrated circuit board 1003 (EGM Processor Board) connected through serial bus line 1005 (e.g., SAS) to game monitoring unit (GMU) 1007 (such as a Bally MC300 or ACSC NT), and player interface integrated circuit board (PIB) 1009 connected to player interface devices 1011 over bus lines 1013, 1017, 1019, 1021, 1023. According to one or more embodiments, PIB 1009 may be implemented using Bally's iView module. Examples of the various bus types that may be used include, but are not limited to, Universal Serial Bus (USB), Ethernet, I2C, and other serial buses. In this embodiment, printer 1025 is connected to PIB 1009 and GMU 1007 over bus lines 1027 and 1029, respectively. According to another embodiment, printer 1025 is connected to base game integrated circuit board 1003 through I/O board 1053. Base game integrated circuit board 1003, PIB 1009, and GMU 1007 connect to Ethernet switch 1031 over bus lines 1033, 1035, and 1037, respectively. Each Ethernet wire may have its own wire connected to the switches outside the gaming cabinet. Ethernet switch 1031 connects to a slot management system (SMS) and a casino management system (CMS) network over bus line 1039—e.g., Virtual Private Network (VPN) and HTTP(S) connections. GMU 1007 also may connect to the SMS and CMS network over bus line 1041. Speakers 1043 connect through audio mixer 1045 and bus lines 1047 (e.g., stereo line out or speaker out) and 1049 to base game integrated circuit board 1003 and PIB 1009. Although audio mixer 1045 is included in this embodiment, it is optional. Furthermore, speakers 1043 may be implemented as part of PIB 1009 in other embodiments. Proximity and biometric devices and circuitry may be installed by upgrading a commercially available PIB 1009, such as a Bally iView unit. Proximity and biometric devices may be connected to GMU 1007. Coding executed on base game integrated circuit board 1003, PIB 1009, and/or GMU 1007 may be upgraded to integrate a game having adjustable multi-part indicia as is more fully described herein.

Peripherals 1051 connect through I/O board 1053 to base game integrated circuit board 1003. Examples of peripherals 1051 include a bill/ticket acceptor, a printer, a card reader, a proximity reader/antenna, a button deck, a touchscreen, a monitor, a light, a biometric reader, and a reel control unit. A peripheral, such as a bill/ticket acceptor, is typically connected to a game input-output board 1053 which is, in turn, connected to a conventional central processing unit ("CPU") base game integrated circuit board 1003, such as an Intel Pentium microprocessor mounted on a gaming motherboard. I/O board 1053 may be connected to base game integrated circuit board 1003 by a serial connection such as RS-232 or USB or may be attached to the processor by a bus such as, but not limited to, an Industry Standard Architecture (ISA) bus. The gaming motherboard may be mounted with other conventional components, such as are found on conventional personal computer motherboards, and loaded with a game program which may include a gaming machine operating system (OS), such as a Bally Alpha OS. Base game integrated circuit board 1003 executes a game program that causes base game integrated circuit board 1003 to play a game. In one embodiment, the game program provides a slot machine game having adjustable multi-part indicia. The various components and included devices may be installed with conventionally and/or commercially available components, devices, and circuitry into a conventional and/or commercially available gaming machine cabinet, examples of which are described above.

When a player has inserted a form of currency such as, for example and without limitation, paper currency, coins or tokens, i tickets or vouchers, electronic funds transfers or the like into the currency acceptor, a signal is sent by way of I/O board 1053 to base game integrated circuit board 1003 which, in turn, assigns an appropriate number of credits for play in accordance with the game program. The player may further control the operation of the gaming machine by way of other peripherals 1051, for example, to select the amount to wager via electromechanical or touch screen buttons. The game starts in response to the player operating a start mechanism such as a handle or touch screen icon. The game program includes a random number generator to provide a display of randomly selected indicia on one or more displays. In some embodiments, the random generator may be physically separate from gaming machine 1001. For example, it may be part of a central determination host system which provides random game outcomes to the game program. Thereafter, the player may interact with the game through electromechanical or touch screen buttons to change the displayed indicia. Base game integrated circuit board 1003, under control of the game program and OS, compares the final display of indicia to a pay table. The set of possible game outcomes may include a subset of outcomes related to the triggering of a feature game. In the event the displayed outcome is a member of this subset, base game integrated circuit board 1003, under control of the game program and by way of I/O board 1053, may cause feature game play to be presented on a feature display.

Predetermined payout amounts for certain outcomes, including feature game outcomes, are stored as part of the game program. Such payout amounts are, in response to instructions from base game integrated circuit board 1003, provided to the player in the form of coins, credits or currency via I/O board 1053 and a pay mechanism, which may be one or more of a credit meter, a coin hopper, a voucher printer, an electronic funds transfer protocol or any other payout means known or developed in the art.

In various embodiments, the game program is stored in a memory device (not shown) connected to or mounted on the gaming motherboard. By way of example, but not by limitation, such memory devices include external memory devices, hard drives, CD-ROMs, DVDs, and flash memory cards. In an alternative embodiment, the game programs are stored in a remote storage device. In one embodiment, the remote storage device is housed in a remote server. The gaming machine may access the remote storage device via a network connection, including but not limited to, a local area network connection, a TCP/IP connection, a wireless connection, or any other means for operatively networking components together. Optionally, other data including graphics, sound files and other media data for use with the EGM are stored in the same or a separate memory device (not shown). Some or all of the game program and its associated data may be loaded from one memory device into another, for example, from flash memory to random access memory (RAM).

In one or more embodiments, peripherals may be connected to the system over Ethernet connections directly to the appropriate server or tied to the system controller inside the EGM using USB, serial or Ethernet connections. Each of the respective devices may have upgrades to their firmware utilizing these connections.

GMU 1007 includes an integrated circuit board and GMU processor and memory including coding for network communications, such as the G2S (game-to-system) protocol from the Gaming Standards Association, Las Vegas, Nev., used for system communications over the network. As shown, GMU 1007 may connect to card reader 1055 through bus 1057—e.g., an External Peripheral Interface (EPI)—and may thereby obtain player card information and transmit the information over the network through bus 1041 (e.g., RS485 bus). Gaming activity information may be transferred by the base game integrated circuit board 1003 to GMU 1007 where the information may be translated into a network protocol, such as server-to-server (S2S), for transmission to a server (e.g., player tracking server), where information about a player's playing activity may be stored in a designated server database.

PIB 1009 includes an integrated circuit board, PID processor, and memory which includes an operating system, such as Windows® CE, a player interface program which may be executable by the PID processor together with various input/output (I/O) drivers for respective devices which connect to PIB 1009, such as player interface devices 1011, and which may further include various games or game components playable on PIB 1009 or playable on a connected network server, and PIB 1009 is operable as the player interface. PIB 1009 connects to card reader 1055 through bus 1023 (e.g., EPI bus), display 1059 through video decoder 1061 and bus 1021, such as a Low-Voltage Differential Signaling (LVDS) or VGA bus.

As part of its programming, the PID processor executes coding to drive display 1059 and provide messages and information to a player. Touch screen circuitry 1063 interactively connects display 1059 and video decoder 1061 to PIB 1009 such that a player may input information and cause the information to be transmitted to PIB 1009 either on the player's initiative or responsive to a query by PIB 1009. Additionally, soft keys 1065 connect through bus 1017 to PIB 1009 and operate together with display 1059 to provide information or queries to a player and receive responses or queries from the player. PIB 1009, in turn, communicates over the CMS/SMS network through Ethernet switch 1031 and buses 1035, 1039 and with respective servers, such as a player tracking server.

Player interface devices 1011 are linked into the virtual private network of the system components in gaming machine 1001. The system components include the iView processing board and game monitoring unit (GMU) processing board. These system components may connect over a network to the slot management system (such as a commercially available Bally SDS/SMS) and/or casino management system (such as a commercially available Bally CMP/CMS).

The GMU system component has a connection to the base game through a serial attached SCSI (SAS) connection and is connected to various servers using, for example, HTTP(S) over Ethernet. Through this connection, firmware, media, operating system software, and gaming machine configurations can be downloaded to the system components from the servers. This data is authenticated prior to install on the system components.

The system components include the iView processing board and game monitoring unit (GMU) processing board. The GMU and iView can be combined into one like the commercially available Bally GTM iView device. This device may have a video mixing technology to mix the EGM processor's video signals with the iView display onto the top box monitor or any monitor on the gaming device.

Figure 11:
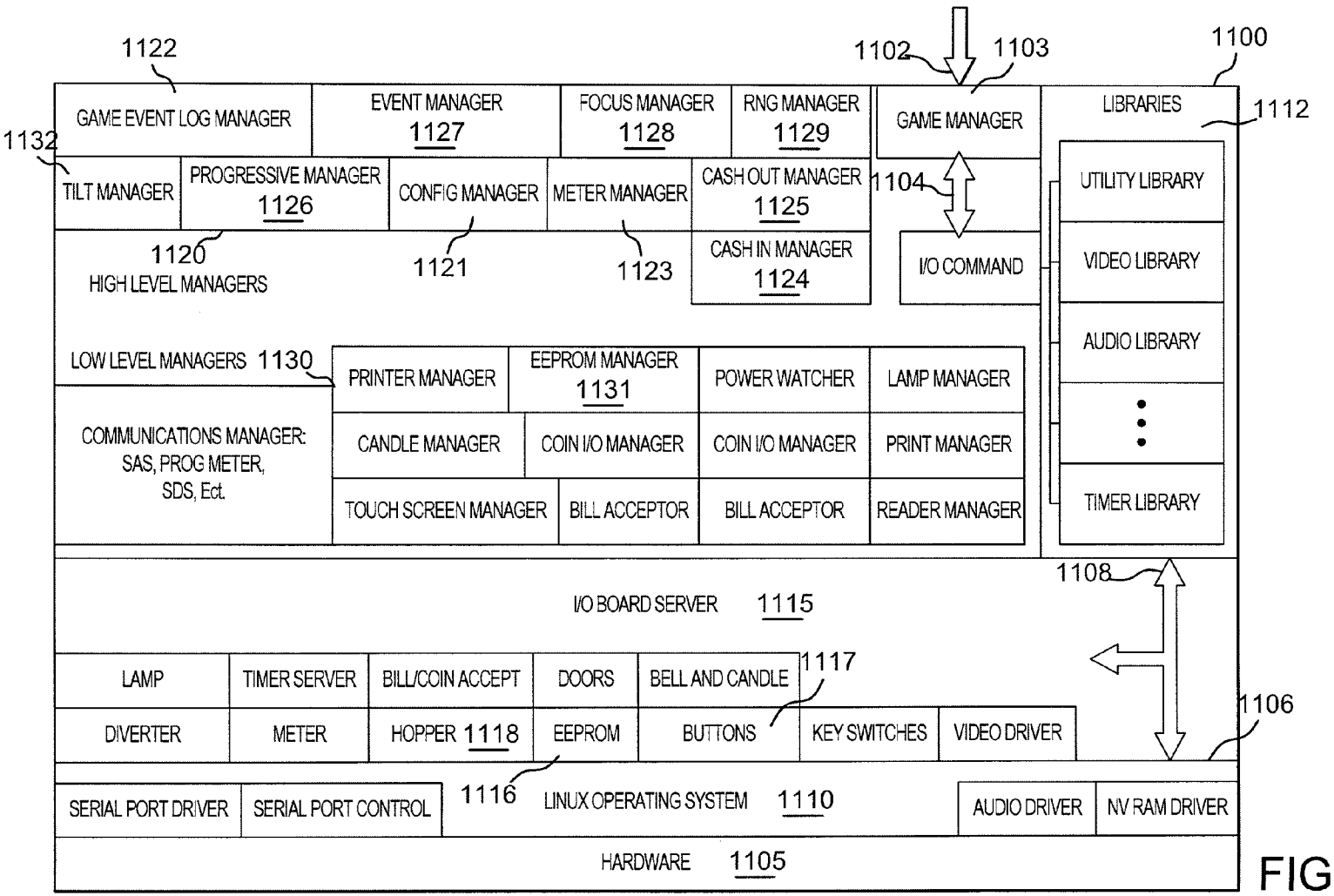
FIG. 11 illustrates a block diagram of the logical components of an exemplary gaming kernel in accordance with one or more embodiments.

In accordance with one or more embodiments, FIG. 11 illustrates a functional block diagram of a gaming kernel 1100 of a game program under control of base game integrated circuit board 1003. The game program uses gaming kernel 1100 by calling into application programming interface (API) 1102, which is part of game manager 1103. The components of game kernel 1100 as shown in FIG. 11 are only illustrative and should not be considered limiting. For example, the number of managers may be changed, additional managers may be added or some managers may be removed without deviating from the scope and spirit of the disclosed system and method.

FIG. 11 shows three layers: a hardware layer 1105; an operating system layer 1110, such as, but not limited to, Linux; and a game kernel layer 1100 having game manager 1103 therein. In one or more embodiments, the use of a standard operating system 1110, such a UNIX-based or Windows-based operating system, allows game developers interfacing to the gaming kernel to use any of a number of standard development tools and environments available for the operating systems. This is in contrast to the use of proprietary, low-level interfaces which may require significant time and engineering investments for each game upgrade, hardware upgrade, or feature upgrade. The game kernel layer 1100 executes at the user level of the operating system 1110 and contains an I/O board server 1115. According to the embodiment of FIG. 11, to set the bounds of game applications and make integrity checking easier, game applications interact with gaming kernel 1100 using a single API 1102 in game manager 1103. This enables game applications to make use of a well-defined, consistent interface, as well as making access points to gaming kernel 1100 controlled, where overall access is controlled using separate processes.

For example, game manager 1103 parses an incoming command stream and, when a command dealing with I/O is received (arrow 1104), the command is sent to an applicable library routine 1112. Library routine 1112 decides what it needs from a device and sends commands to I/O board server 1115 (see arrow 1108). A few specific drivers remain in operating system 1110's kernel, shown as those below line 1106. These are built-in, primitive, or privileged drivers that are (i) general, (ii) kept to a minimum, and (iii) easier to leave than extract. In such cases, the low-level communications is handled within operating system 1110 and the contents are passed to library routines 1112.

Thus, in a certain cases, library routines may interact with drivers inside operating system 1110, which is why arrow 1108 is shown as having three directions (between library utilities 1112 and I/O board server 1115, or between library utilities 1112 and certain drivers in operating system 1110). The logic for interfacing with each device is coded into modules in the user layer of the diagram. Operating system 1110 is kept as simple, stripped down, and common across as many hardware platforms as possible. The library utilities and user-level drivers change as dictated by the game cabinet or game machine in which it runs. Thus, each game cabinet or game machine may have a base game integrated circuit board 1003 connected to an I/O adapter board 1053, plus a gaming kernel 1100 having the game-machine-unique library routines and I/O board server 1115 components needed to enable game applications to interact with the gaming machine cabinet. Differences in the underlying hardware between several machines are generally invisible to the game application software with the exception of certain functional differences (e.g., if a gaming cabinet has stereo sound, the game application makes use of API 1102 to use the capability over that of a cabinet having traditional monaural sound).

Game manager 1103 provides an interface into game kernel 1100, providing consistent, predictable, and backwards compatible calling methods, syntax, and capabilities by way of game application API 1102. Interfacing through API 1102 frees game developers from having to deal directly with the hardware and low-level drivers. It also frees them from having to program lower-level managers 1130, although lower-level managers 1130 may be accessible through game manager 1103's interface 1102 if a developer has the need. In addition to freeing developers from having to deal with the hardware level drivers and providing consistent, callable, object-oriented interfaces to software managers of those components (drivers), game manager 1103 provides access to a set of upper-level managers 1120 also having the advantages of consistent callable, object-oriented interfaces, and further providing the types and kinds of base functionality required in casino-type games. Game manager 1103, providing all the advantages of its consistent and richly functional interface 1102 as supported by the rest of game kernel 1100, thus provides a game developer with a multitude of advantages.

Game manager 1103 may have several objects within itself, including an initialization object (not shown). The initialization object performs the initialization of the game machine, including other objects, after game manager 1103 has started its internal objects and servers. The kernel's configuration manager 1121 is among the first objects to be started and contains data for initializing and configuring other objects or servers.

The upper-level managers 1120 of game kernel 1100 may include game event log manager 1122 which provides, at the least, a logging or logger base class that enables other logging objects to be derived from this base object. The logger object is a generic logger; that is, it is not aware of the contents of logged messages and events. The event log manager's (1122) job is to log events in non-volatile event log space. The size of the space may be fixed, although the size of the logged event is typically not. Consistent with one or more embodiments, when the event space or log space fills up, the log manager 1122 deletes the oldest logged events (each logged event has a time/date stamp, as well as other needed information such as length) to provide space to record new events. As a result, the most recent events are found in the log space, regardless of their relative importance. Further provided is the capability to read the stored logs for event review.

In accordance with one embodiment, meter manager 1123 manages the various meters embodied in the game kernel 1100. This includes the accounting information for the game machine and game play. There are hard meters (counters) and soft meters. The soft meters may be stored in non-volatile storage such as non-volatile battery-backed RAM to prevent loss. Further, a backup copy of the soft meters may be stored in a separate non-volatile storage such as EEPROM. In one embodiment, meter manager 1123 receives its initialization data for the meters, during start-up, from configuration manager 1121. While running, the cash-in (1124) and cash-out (1125) managers call the meter manager's (1123) update functions to update the meters. Meter manager 1123, on occasion, creates backup copies of the soft meters by storing the soft meters' readings in EEPROM. This is accomplished by calling and using EEPROM manager 1131.

In accordance with other embodiments, progressive manager 1126 manages progressive games playable from the game machine. Event manager 1127 is generic, like log manager 1122, and is used to manage various gaming machine events. Focus manager 1128 correlates which process has control of various focus items. Tilt manager 1132 is an object that receives a list of errors (if any) from configuration manager 1121 at initialization and during game play from processes, managers, drivers, and the like. that may generate errors. Random number generator manager 1129 is provided to allow easy programming access to a random number generator (RNG), as a RNG is used in casino-style (gambling) games. RNG manager 1129 is capable of using multiple seeds.

In accordance with one or more embodiments, a credit manager object (not shown) manages the current state of credits (cash value or cash equivalent) in the game machine, including any available winnings, and further provides denomination conversion services. Cash-out manager 1125 has the responsibility of configuring and managing monetary output devices. During initialization, cash-out manager 1125 uses data from configuration manager 1121 to set up the cash-out devices and select cash-out denominations. During play, a game application may post a cash-out event through the event manager 1127 (the same way all events are handled). Using a call-back posted by cash-out manager 1125, cash-out manager 1125 is informed of the event. Cash-out manager 1125 updates the credit object and its state in non-volatile memory and sends an appropriate control message to the device manager that corresponds to the dispensing device. As the device dispenses dispensable media, there are typically event messages being sent back and forth between the device and cash-out manager 1125 until the dispensing finishes, after which cash-out manager 1125, having updated the credit manager and any other game state (such as some associated with meter manager 1123) that needs to be updated for this set of actions, sends a cash-out completion event to event manager 1127 and to the game application thereby. Cash-in manager 1124 functions similarly to cash-out manager 1125, only controlling, interfacing with, and taking care of actions associated with cash-in events, cash-in devices, and associated meters and crediting.

In a further example, in accordance with one or more embodiments, I/O board server 1115 may write data to the gaming machine EEPROM memory, which is located in the gaming machine cabinet and holds meter storage even in the event of power failure. Game manager 1103 calls the I/O library functions to write data to the EEPROM. The I/O board server 1115 receives the request and starts a low priority EEPROM thread 1116 within I/O board server 1115 to write the data. This thread uses a sequence of 11-bit command and data writes to the EEPROM device to write the appropriate data in the proper location within the device. Any errors detected are sent as inter-process communication (IPC) messages to game manager 1103. The above-described processing operations may be performed asynchronously.

In accordance with one embodiment, button module 1117 within I/O board server 1115 polls (or is sent) the state of buttons periodically (e.g., every 2 ms). These inputs are debounced by keeping a history of input samples. A button press is detected based on certain sequences of input samples, in which case the I/O board server 1115 sends an IPC event to game manager 1103 to indicate that a button was pressed or released. In some embodiments, the gaming machine may have intelligent, distributed I/O that debounces the buttons, in which case button module 1117 may be able to communicate with the remote intelligent button processor to get the button events and simply relay them to game manager 1103 via IPC messages. In another embodiment, the I/O library may be used for pay out requests from the game application. For example, hopper module 1118 starts the hopper motor, monitors the coin sensing lines of the hopper, debounces them, and sends an IPC message to the game manager 1103 when each coin is paid.

Further details, including disclosure of lower-level fault handling and/or processing, are included in U.S. Pat. No. 7,351,151 entitled "Gaming Board Set and Gaming Kernel for Game Cabinets" and provisional U.S. patent application No. 60/313,743, entitled "Form Fitting Upgrade Board Set For Existing Game Cabinets," filed Aug. 20, 2001; said patent and provisional are both fully incorporated herein by explicit reference.

Figure 12A:
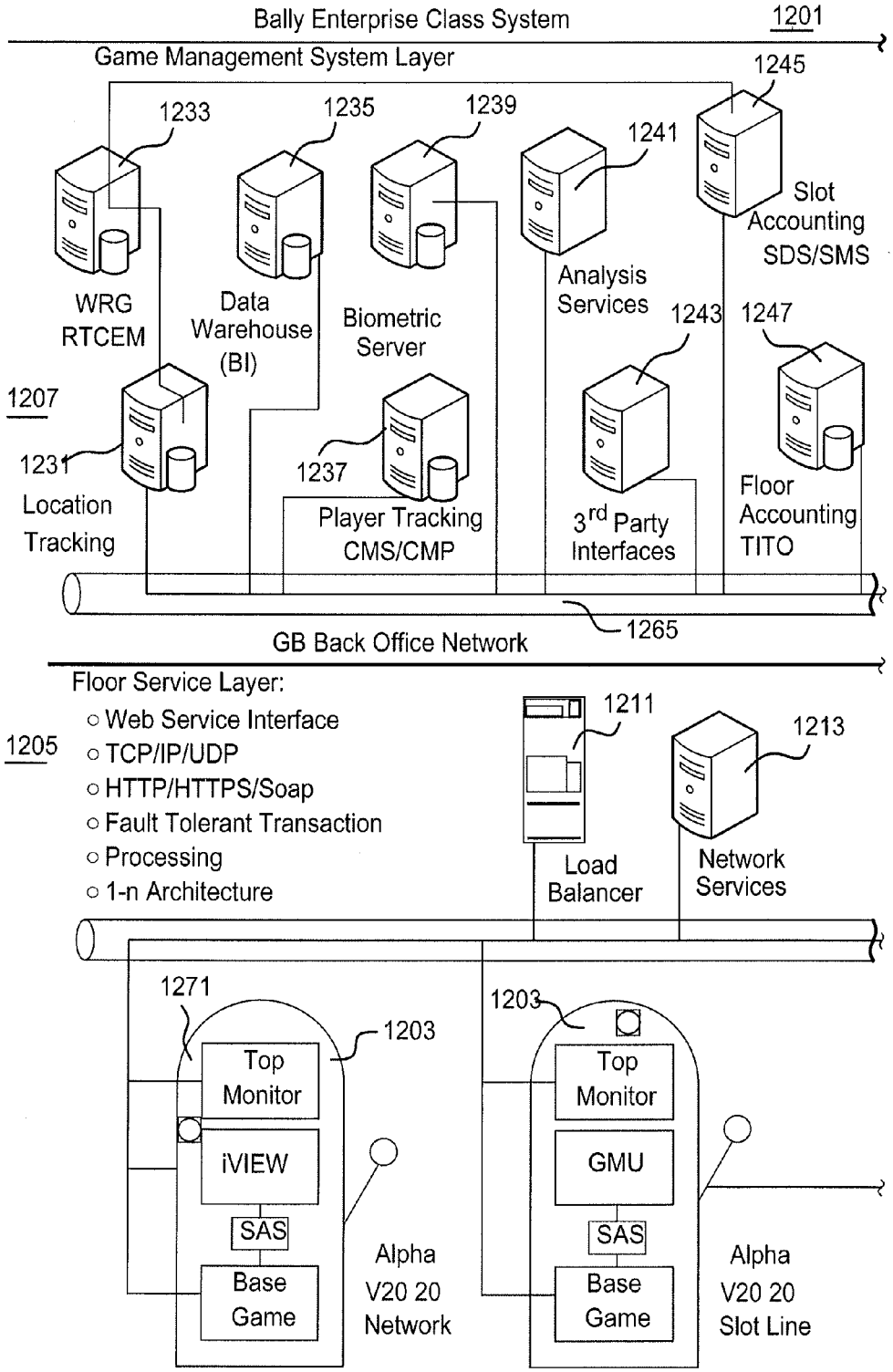
FIGS. 12A-12B illustrates a schematic block diagram showing the hardware elements of an exemplary networked gaming system in accordance with one or more embodiments.
Figure 12B:
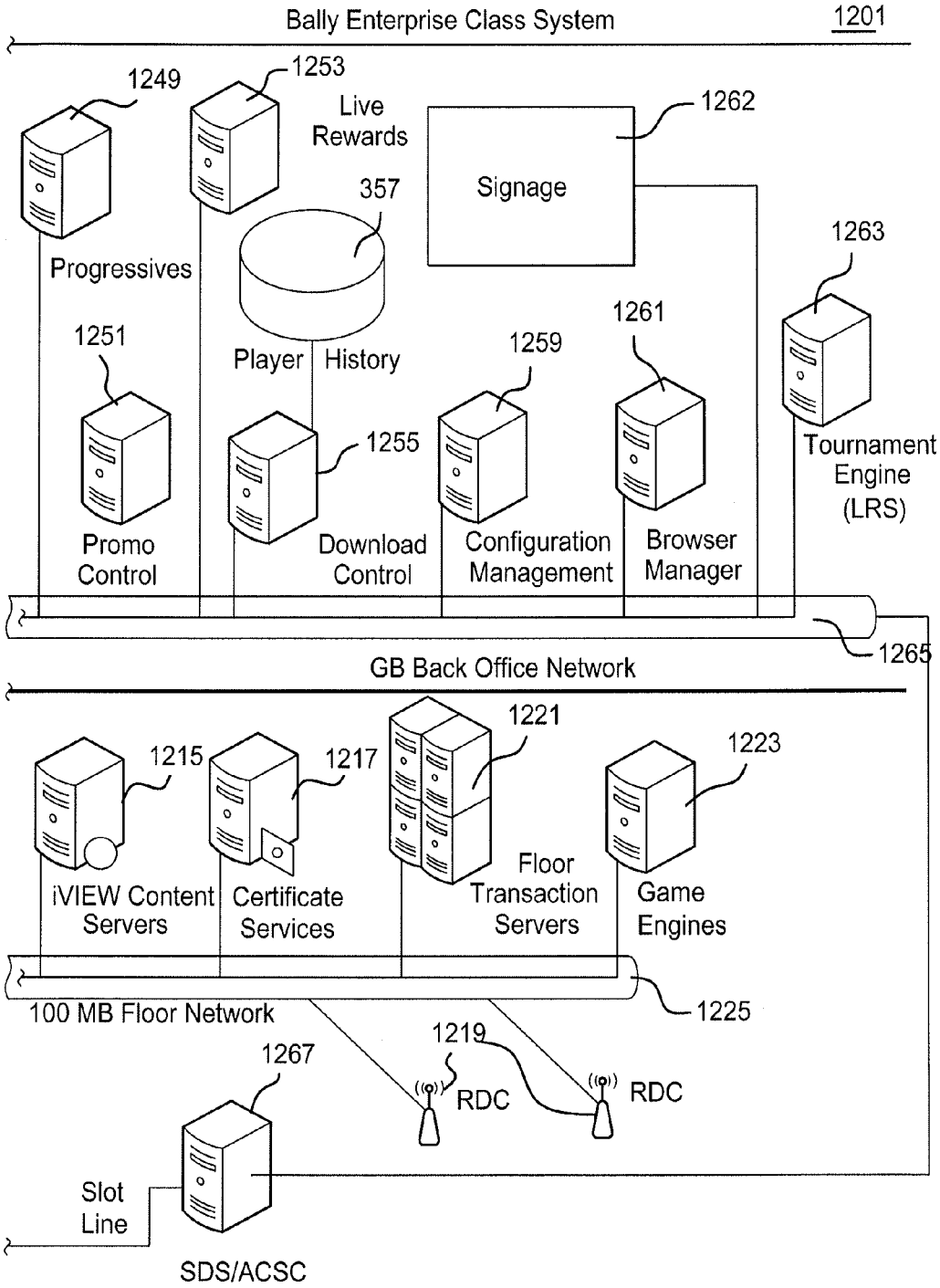

Referring to FIGS. 12A-12B, enterprise gaming system 1201 is shown in accordance with one or more embodiments. Enterprise gaming system 1201 may include one casino or multiple locations and generally includes a network of gaming machines 1203, slot management system (SMS) 1205, and casino management system (CMS) 1207. SMS 1205 may include load balancer 1211, network services servers 1213, player interface (iView) content servers 1215, certificate services server 1217, floor radio dispatch receiver/transmitters (RDC) 1219, floor transaction servers 1221 and game engines 1223, each of which may connect over network bus 1265 to gaming machines 1203. CMS 1207 may include location tracking server 1231, WRG RTCEM server 1233, data warehouse server 1235, player tracking server 1237, biometric server 1239, analysis services server 1241, third-party interface server 1243, slot accounting server 1245, floor accounting server 1247, progressives server 1249, promo control server 1251, feature game (such as Bally Live Rewards) server 1253, download control server 1255, player history database 1257, configuration management server 1259, browser manager 1261, tournament engine server 1263 connecting through bus 1265 to server host 1267 and gaming machines 1203.

The various servers and gaming machines 1203 may connect to the network with various conventional network connections (such as, for example, USB, serial, parallel, RS485, Ethernet). Additional servers which may be incorporated with CMS 1207 include a responsible gaming limit server (not shown), advertisement server (not shown), and a control station server (not shown) where an operator or authorized personnel may select options and input new programming to adjust each of the respective servers and gaming machines 1203. SMS 1205 may also have additional servers including a control station (not shown) through which authorized personnel may select options, modify programming, and obtain reports of the connected servers and devices. The various CMS and SMS servers are descriptively entitled to reflect the functional executable programming stored thereon and the nature of databases maintained and utilized in performing their respective functions.

Gaming machines 1203 include various peripheral components that may be connected with USB, serial, parallel, RS485 or Ethernet devices/architectures to the system components within the respective gaming machine. The GMU has a connection to the base game through an SAS connection. The system components in the gaming cabinet may be connected to the servers using HTTP(S) or Game-to-Server (G2S) over Ethernet. Using CMS 1207 and/or SMS 1205 servers and devices, firmware, media, operating systems, and configurations may be downloaded to the system components of respective gaming machines for upgrading or managing floor content and offerings in accordance with operator selections or automatically depending upon CMS 1207 and SMS 1205 master programming. The data and programming updates to gaming machines 1203 are authenticated using conventional techniques prior to install on the system components.

In various embodiments, any of the gaming machines 1203 may be a mechanical reel spinning slot machine or a video slot machine or a gaming machine offering one or more of the above described games including a group play game. Alternately, gaming machines 1203 may provide a game with a simulated musical instrument interface as a primary or base game or as one of a set of multiple primary games selected for play by a random number generator. A gaming system of the type described above also enables a plurality of games, in accordance with the various embodiments, to be linked under the control of a group game server (not shown) for cooperative or competitive play in a particular area, carousel, casino or between casinos located in geographically separate areas. For example, one or more examples of group games under control of a group game server are disclosed in U.S. application Ser. No. 11/938,079, entitled "Networked System and Method for Group Play Gaming," filed on Nov. 9, 2007, which is hereby incorporated by reference in its entirety for all purposes.

Figure 13:
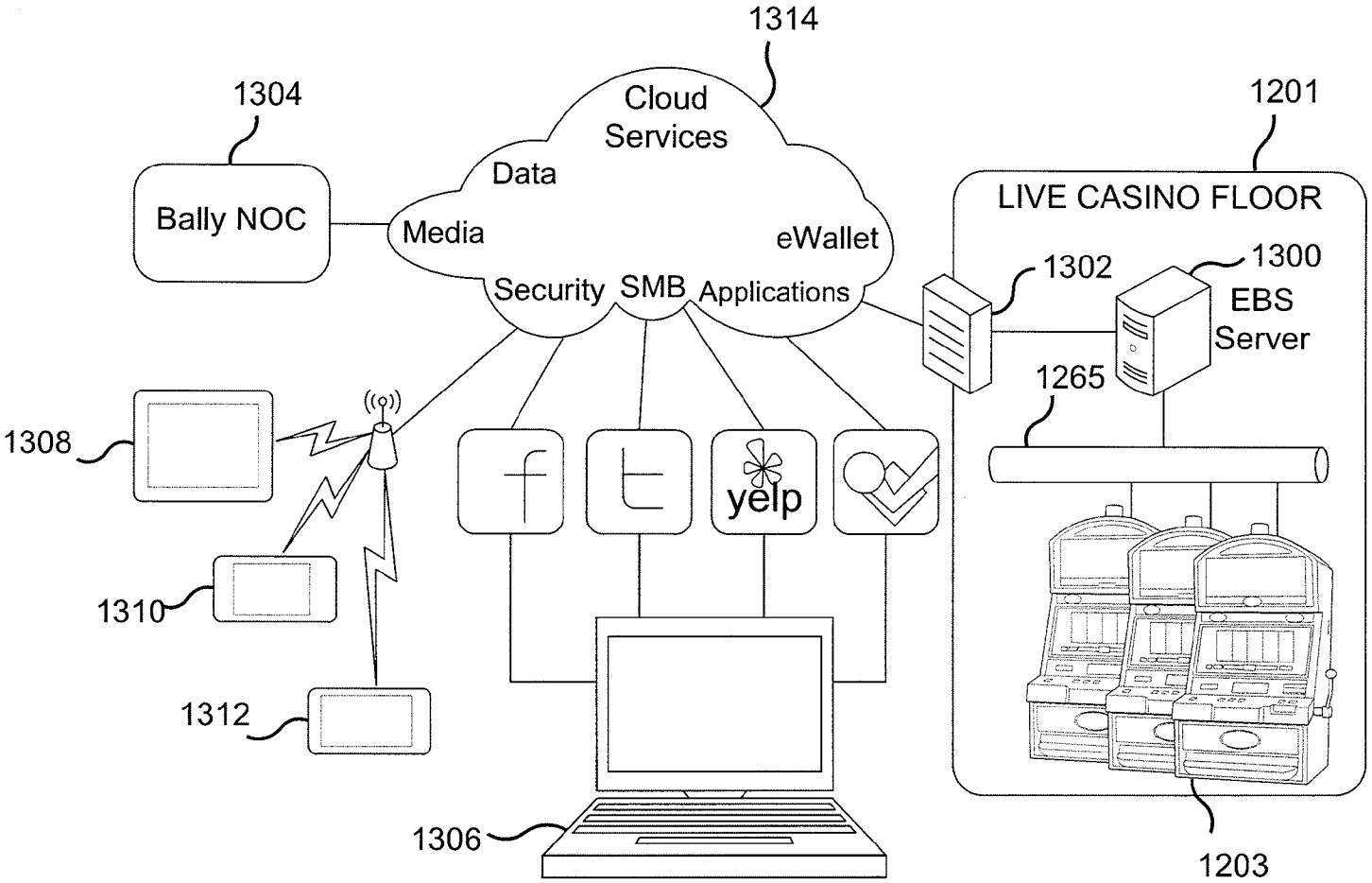
FIG. 13 illustrates a diagram of an exemplary architecture for tying a casino enterprise network to an external provider of games and content to Internet or broadband communication-capable devices in accordance with one or more embodiments.

All or portions of the disclosed system and method to provide user-configurable preferences and/or options for team play may also be implemented or promoted by or through a system as shown in FIG. 13. A gaming system, such as gaming system 1201 of FIGS. 12A-12B, is connected to a cloud computing/storage service 1304. The game system 1201 may be hosted at a casino property enterprise, across several casino enterprises, or by a third-party host. As described above, the gaming system 1201 has a network communication bus 1265 that provides for communication between the gaming terminals 1203 and various servers. A bonusing server (EBS) 1300, such as a Bally Elite Bonusing Server is connected to the network communication bus 1265 (FIGS. 12A-12B) and communicates with the components of the gaming system 1201, including the gaming terminals 1203 and the various servers and other devices as described above. The bonusing server 1300 also communicates with a cloud computing/storage service 1314 through a secure network firewall 1302. The cloud computing/storage service 1314 may be hosted by the casino enterprise, a licensed third party or, if permitted by gaming regulators, an unlicensed provider. For example, the cloud service 1314 may be as provided by Microsoft® Private Cloud Solutions offered by Microsoft Corp. of Redmond, Wash., USA. The cloud service 1314 provides various applications which can be accessed and delivered to, for example, personal computers 1306, portable computing devices such as computer tablets 1308, personal digital assistants (PDAs) 1310, and cellular devices 1312 such as telephones and smart phones. According to one or more embodiments, the cloud service 1314 may store and host an eWallet application, casino or player-centric applications such as downloadable or accessible applications including games, promotional material or applications directed to and/or affecting a casino customer's interaction with a casino enterprise (such as accessing the player's casino account, establishing casino credit or the like), providing bonuses to players through system-wide bonusing (SMB) or specific bonusing or comps to players, or other applications. The cloud service 1314 includes security applications that provide secure communication between the players/users and the cloud service 1314 and between the cloud service 1314 and the gaming system 1201. Security applications may implement encryption, the use of personal identification numbers (PINS) or other devices and systems. The cloud service 1314 stores player/user data retrieved from players/users and from the gaming system 1201.

The players/users may access the cloud service 1314 and the applications and data provided thereby through the Internet and through broadband wireless cellular communication systems and any intervening short range wireless communication such as WiFi. The players/users may access the applications and data through various social media offerings such as Facebook®, Twitter®, Yelp®, MySpace®, LinkedIn® or the like.

For example, a player/user may have a player account with a casino enterprise Z. That account may include data such as the player's credit level, his rating, and his available comps. The account may further track any certificates, and the present value thereof, that the player may have won as a result of playing a game according to the disclosed system and method to provide user-configurable preferences and/or options for team play. Using his smart phone 1312, the player/user sends a request to the cloud service 1314 (perhaps through a previously downloaded application) to request the status of his available comps, such as how many comp points he has and what may be redeemed with those points (e.g., lodging, cash back, meals or merchandise). To access the player/user's account, the application may request the player/user to enter his PIN. The application may present casino promotions, graphics, or other advertising to the player/uSerial The cloud service 1314 forwards the inquiry to the bonusing server 1300 which, in turn, confirms the PIN and retrieves the requested information from the data warehouse 1235 (FIGS. 12A-12B) or player tracking CMS/CMP server 1237 (FIGS. 12A-12B). According to one embodiment, the data may be stored in the cloud service 1314 and routinely updated from the data warehouse 1235 or player tracking CMS/CMP server 1237. In such case, the cloud service 1314 would respond to the request based on the data stored in the cloud service 1314. Prior to delivering the requested information to the player/user, the cloud server 1314 may format the information based upon the player/user's device operating system (OS), display size, or the like.

The cloud service 1314 may also host game applications to provide virtual instances of games for free, promotional, or pay-to-play (P2P) gaming. Third-party developers may place applications with the cloud service 1314 through, for example, a national operations center (Bally NOC 1304). A game software manufacturer such as Bally Gaming, Inc. may also provide game applications on its own or on behalf of the casino enterprise.

Other media, such as advertising and notices of events (such as an upcoming tournament), may also be provided by the cloud service 1314. When a player/user accesses the cloud service 1314, certain media may be delivered to the player/user in a manner formatted for their application and device.

Although the description above contains much specificity, these should not be construed as limiting the scope of the disclosed system and method but as merely providing an illustration of the several embodiments thereof.

The invention claimed is:

1. A computer-implemented gaming system, comprising:

a gaming machine memory device having stored thereon a gaming application that enables multiplayer, turn-based gameplay of a primary game among two or more players;

a plurality of input devices including:

(a) an acceptor of a first physical item associated with a first monetary value; and (b) a cashout button actuatable to cause an initiation of a payout associated with a credit balance;

a gaming machine computer-processing unit that is operatively connected to the gaming machine memory device and processes the gaming application to:

enable the two or more players to specify a condition for determining when a player's turn at primary gameplay ends, wherein the condition for determining when a player's turn at primary gameplay ends is player-selectable prior to beginning primary gameplay;

determine that the condition is satisfied for a current player; and generate a message to indicate that the current player's turn at primary gameplay is terminated; and a gaming machine display that displays the generated message to the two or more players.

2. The computer-implemented gaming system of claim 1, wherein the computer-processing unit further processes the gaming application to enable the two or more players to specify whether accumulated game points are shared among multiple player gaming accounts.

3. The computer-implemented gaming system of claim 1, wherein the computer-processing unit further processes the gaming application to track and assign individual accumulation of game points by each player to respective player gaming accounts.

4. The computer-implemented gaming system of claim 1, wherein to enable the two or more players to specify a condition comprises to provide a plurality of preset conditions from which the two or more players select.

5. The computer-implemented gaming system of claim 4, wherein the plurality of preset conditions includes at least two of:

a condition in which a player plays one game each turn;

a condition in which a player plays a user-specified number of games each turn;

a condition in which a player keeps playing until the player wins a game; and a condition in which a player keeps playing until the player accumulates a user-specified number of game points.

6. The computer-implemented gaming system of claim 1, wherein the computer-processing unit further processes the gaming application to enable the two or more players to be added to a team.

7. The computer-implemented gaming system of claim 6, wherein the computer-processing unit further processes the gaming application to identify and add a player to the team based on the player's login credentials for a third-party, social-networking account.

8. The computer-implemented gaming system of claim 1, wherein the computer-processing unit further processes the gaming application to determine an order of gameplay among the two or more players based on at least one of a user-preset order and a random order.

9. The computer-implemented gaming system of claim 8, wherein the computer-processing unit further processes the gaming application to enable the two or more players to change the order of gameplay during a player's turn.

10. The computer-implemented gaming system of claim 1, further comprising a single user-input interface for receiving user input from the two or more players.

11. A computer-implemented gaming system, comprising:

a plurality of input devices including: (a) an acceptor of a first physical item associated with a first monetary value; and (b) a cashout button actuatable to cause an initiation of a payout associated with a credit balance;

a non-transitory, computer-readable gaming machine medium having stored thereon computer-executable instructions that, when executed by a gaming machine computer processor, cause the gaming machine computer processor to:

provide a multiplayer, turn-based primary game among two or more players;

enable the two or more players to specify a condition for determining when a player's turn at primary gameplay ends;

determine that the condition is satisfied for a current player, wherein the condition for determining when a player's turn at primary gameplay ends is player-selectable prior to beginning primary gameplay;

generate a message to indicate that the current player's turn at primary gameplay is terminated; and display, via a gaming machine display, the generated message to the two or more players.

12. The non-transitory, computer-readable medium of claim 11, further comprising computer-executable instructions, that when executed by the computer processor, cause the computer processor to enable the two or more players to specify whether accumulated game points are shared among multiple player gaming accounts.

13. The non-transitory, computer-readable medium of claim 11, further comprising computer-executable instructions, that when executed by the computer processor, cause the computer processor to track and assign the individual accumulation of game points by each player to his respective gaming account.

14. The non-transitory, computer-readable medium of claim 11, wherein to enable the two or more players to specify a condition comprises to provide a plurality of preset conditions from which the two or more players select.

15. The non-transitory, computer-readable medium of claim 14, wherein the plurality of preset conditions includes at least two of:

a condition in which a player plays one game each turn;

a condition in which a player plays a user-specified number of games each turn;

a condition in which a player keeps playing until the player wins a game; and a condition in which a player keeps playing until the player accumulates a user-specified number of game points are accumulated.

16. The non-transitory, computer-readable medium of claim 11, further comprising computer-executable instructions that, when executed by the computer processor, cause the computer processor to enable the two or more players to be added to a team.

17. The non-transitory, computer-readable medium of claim 16, further comprising computer-executable instructions that, when executed by the computer processor, cause the computer processor to identify and add a player to the team based on the player's login credentials for a third-party, social-networking account.

18. The non-transitory, computer-readable medium of claim 11, further comprising computer-executable instructions that, when executed by the computer processor, cause the computer processor to determine an order of gameplay among the two or more players based on at least one of a user-preset order and a random order.

19. The non-transitory, computer-readable medium of claim 18, further comprising computer-executable instructions that, when executed by the computer processor, cause the computer processor to enable the two or more players to change the order of gameplay during a player's turn.

20. A computer-implemented method, comprising:

providing a gaming machine memory device having stored thereon a gaming application that enables multiplayer, turn-based gameplay of a primary game among two or more players;

providing a plurality of input devices including: (a) an acceptor of a first physical item associated with a first monetary value; and (b) a cashout button actuatable to cause an initiation of a payout associated with a credit balance;

providing a gaming machine computer-processing unit that is operatively connected to the memory device;

displaying a multiplayer, turn-based primary game to two or more players on a gaming machine computer-driven display;

receiving, via a gaming machine user-input device, user input from the two or more players, the user input includes specifying a condition for determining when a player's turn at primary gameplay ends;

performing calculations based on the primary game's instructions and user-specified parameters to determine that the condition is satisfied for a current player, wherein the condition for determining when a player's turn at primary gameplay ends is player-selectable prior to beginning primary gameplay;

generating a message to indicate that the current player's turn at primary gameplay is terminated; and displaying, via the gaming machine display, the generated message to the current player on the computer-driven display.

* * * * *